US005356574A

United States Patent [19]

Tamaki et al.

[11] Patent Number: 5,356,574

[45] Date of Patent: Oct. 18, 1994

[54] PROCESS FOR PRODUCING PITCH BASED ACTIVATED CARBON FIBERS AND CARBON FIBERS

[75] Inventors: Toshio Tamaki; Hideyuki Nakajima; Yoshiyuki Nishimura; Hiroshi Ejiri, all of Kamisu, Japan

[73] Assignee: Petoca, Ltd., Tokyo, Japan

[21] Appl. No.: 118,742

[22] Filed: Sep. 10, 1993

[30] Foreign Application Priority Data

Sep. 22, 1992 [JP] Japan ..... 4-252940
Mar. 16, 1993 [JP] Japan ..... 5-080306

[51] Int. Cl.[5] ..... D01F 9/145

[52] U.S. Cl. ..... 264/29.2; 264/29.6; 264/29.7; 423/447.6; 423/447.7; 423/447.8; 423/448

[58] Field of Search ..... 264/29.2, 29.6, 29.7, 264/83; 423/447.4, 447.6, 447.7, 447.8, 448

[56] References Cited

U.S. PATENT DOCUMENTS

| | | | |
|---|---|---|---|
| 4,863,708 | 9/1989 | Seo et al. | 423/447.4 X |
| 5,037,697 | 8/1991 | Fujisawa | 264/29.2 X |
| 5,183,603 | 2/1993 | Kitajima et al. | 264/29.2 |

FOREIGN PATENT DOCUMENTS

| | | | |
|---|---|---|---|
| 0482910 | 4/1992 | European Pat. Off. . | |
| 58-18421 | 2/1983 | Japan | 264/29.2 |
| 59-116421 | 7/1984 | Japan | 264/29.2 |
| 61-132629 | 6/1986 | Japan . | |
| 62-27315 | 2/1987 | Japan . | |
| 62-170528 | 7/1987 | Japan . | |
| 63-53294 | 10/1988 | Japan . | |
| 2005298 | 4/1979 | United Kingdom . | |

OTHER PUBLICATIONS

Translation of Japan 58-18,421 (published Feb. 1983).
Translation of Japan 59-116,421 (published Jul. 1984).
Carbon, vol. 30, No. 5, pp. 773-779, 1992, Hiroshi Toshima, et al., "Modification of Petroleum-Derived Mesophase Pitch by Blending Naphthalene-Derived Partially Isotropic Pitches".

*Primary Examiner*—Leo B. Tentoni
*Attorney, Agent, or Firm*—Oblon, Spivak, McClelland, Maier & Neustadt

[57] ABSTRACT

A process for providing activated carbon fibers consisting of optically anisotropic components and optically isotropic components by spinning a pitch into fibers, and infusibilizing the resulting fibers, followed by an activation treatment. The pitch for spinning is prepared by melt mixing together (A) 100 parts by weight of an optically isotropic pitch having a softening point of 230°-300° C. obtained by heat treatment of a pitch while blowing an oxygen containing gas into the pitch, and (B) 10-50 parts by weight of an optically isotropic pitch having a softening point of 200°-270° C. obtained by polymerization of naphthalene in the presence of a Lewis acid catalyst. The optically isotropic pitch (B) is further characterized as having the property of being converted into an optically anisotropic pitch by the stress occurring at the time of spinning. The carbon fibers produced by spinning the spinning pitch into fibers have a double layer structure, the surface layer exhibiting optical isotropy and the center portion exhibiting optical anisotropy. The spun fibers are infusibilized, followed by carbonization and/or graphitization.

6 Claims, No Drawings

PROCESS FOR PRODUCING PITCH BASED ACTIVATED CARBON FIBERS AND CARBON FIBERS

FIELD OF THE INVENTION

This invention relates to a process for producing pitch based activated carbon fibers consisting of optically anisotropic components and optically isotropic components.

More particularly, the present invention relates to the process for producing the activated carbon fibers excellent in spinnability, high in fiber strength, and excellent in sliding property or electrical conductivity, wherein the surface layer portion of the activated carbon fibers consisting essentially of the optically isotropic components and the interior of the activated carbon fibers containing the optically anisotropic components.

The invention also relates to a process for producing pitch based carbon fibers consisting of the optically anisotropic components and optically isotropic components.

BACKGROUND OF THE INVENTION

In recent years, because of having a surface area larger than that of granular activated carbon, activated carbon fibers processed into textile fabric, felt, mat, etc. have come to be used as adsorbents or filters for solvent recovery device or air cleaning system, etc., and have attracted attention.

It is known that such activated carbon fibers may be prepared from such starting materials, for example, as polyacrylonitrile fibers, phenolic resin fibers, cellulosic fibers and pitch fibers. As regards the polyacrylonitrile activated carbon fibers, there has been proposed a method for the preparation thereof, for example, by oxidation treatment of acrylonitrile fibers containing iron compounds at a specific temperature, followed by activation treatment (Japanese Patent Publication No. 53294/1988). In this method, however, there are involved such problems that though the activated carbon fibers obtained have a relatively high strength such as 20–50 kg/mm$^2$, the specific surface area thereof is as small as 700–1200 m$^2$/g, and that the polyacrylonitrile fibers as a starting material are relatively expensive.

As regards the activated carbon fibers prepared from the pitch, there has been proposed a method for the preparation thereof, for example, by spinning an optically isotropic petroleum or coal pitch into fibers, and infusibilizing the resulting fibers, followed by carbonization and activation treatment (Japanese Patent L-O-P Publn. No. 132629/1986 and 27315/1987). In this method, however, there is involved such a problem that the fiber strength of the activated carbon fibers obtained is as low as not more than 20 kg/mm$^2$, though the activated carbon fibers are obtained from a relatively cheap starting material such as pitch and have such a large specific surface area as 1000–2000 m$^2$/g.

In this manner, the activated carbon fibers known in the art prepared from pitch have such a problem that they are poor in fiber strength, though they are low in the production cost thereof and are excellent in specific surface area and adsorption efficiency in comparison with the polyacrylonitrile activated carbon fibers.

Further, the carbon fibers starting from pitch are prepared by spinning petroleum pitch or coal pitch into fibers, and infusibilizing the resulting fibers, followed by carbonization and/or graphitization in an inert gas.

Mechanical properties of the carbon fibers thus prepared, however, are greatly influenced by the properties of the pitch for spinning, and it is known that general purpose (GP) carbon fibers low in strength and modulus of elasticity are obtained from an optically isotropic pitch, and in the meantime high-performance (HP) carbon fibers high in strength and modulus of elasticity are obtained from a mesophase (liquid crystal) pitch containing an optically anisotropic phase.

When the carbon fibers are prepared by using the mesophase pitch, however, because the resulting carbon fibers are oriented in the axial direction of fiber at the time of spinning thereof, the fiber surfaces are liable to cleavage at the time of carbonization and/or graphitization treatment. Various researches have heretofore been made in order to solve the above-mentioned problem.

For example, Japanese Patent L-O-P Publn. No. 170528/1987 discloses a method for inhibiting occurrence of cleavage on the fiber surface of the carbon fibers, wherein a starting pitch is prepared by adding and mixing together an optically isotropic pitch and an optically anisotropic pitch so as to prepare the carbon fibers of a double structure having the surface layer consisting of the optically isotropic components and the center core consisting of the anisotropic components.

In this method, however, the pitch for spinning is prepared by simply melting and mixing together the optically isotropic pitch and the optically anisotropic pitch, and hence the optically anisotropic components are hard to disperse uniformly in the optically isotropic components, with the result that the spinnability of the pitch becomes poor, and no carbon fibers having the abovementioned double structure are obtained with great satisfaction.

OBJECT OF THE INVENTION

The present invention has been made under such circumstances as mentioned above, and an object of the invention is to provide a process for producing efficiently activated carbon fibers having a large specific surface area similar to that of the activated carbon fibers obtained from the optically isotropic pitch and having a high fiber strength by the use as a starting material of pitch which is cheap and abundant.

A further object of the invention is to provide a process for producing efficiently carbon fibers excellent in tensile strength or tensile modulus of elasticity by the use as a starting material of pitch which is cheap and abundant.

SUMMARY OF THE INVENTION

Extensive investigations conducted by the present inventors on the above-mentioned objects of the invention have resulted in the findings that a pitch for spinning obtained by mixing an optically isotropic pitch which is hard to be converted into an optically anisotropic pitch at the time of spinning thereof with an optically isotropic pitch which is readily converted into an optically anisotropic pitch at the time of spinning thereof at a predetermined proportion is spun into fibers having a double structure. The surface layer portion of the fibers shows optical isotropy, and the interior portion of the fibers shows optical anisotropy, and the fibers thus obtained are infusibilized and subjected to activation treatment to obtain activated carbon fibers, the surface portion of the activated carbon fibers shows optical isotropy and the interior portion of the activated carbon fibers shows optical anisotropy, which are large in specific surface area, high in fiber strength, and excellent in electrical conductivity and sliding property. Based on the above findings, the present invention has been accomplished.

Further extensive investigations conducted by the present inventors have resulted in the finding that the fibers having the above-mentioned double structure obtained by spinning the pitch mentioned above and infusibilizing, followed by carbonization and/or graphitization have high strength and high modulus of elasticity and are high in electrical conductivity and sliding property.

The process for producing activated carbon fibers consisting of the optically anisotropic components and isotropic components according to the present invention is characterized in that a pitch for spinning prepared by melt mixing (A) an optically isotropic pitch having a softening point of 230°~300° C. obtained by heat treatment of a pitch while blowing an oxygen containing gas into the pitch and (B) 10~50 parts by weight, based on 100 parts by weight of the pitch (A), of an optically isotropic pitch having a softening point of 200°~270° C. and having a property of being converted into an optically anisotropic pitch by a stress at the time of spinning thereof is spun into fibers and the fibers thus obtained are infusibilized, followed by activation.

The process for producing carbon fibers consisting of the optically anisotropic components and optically isotropic components according to the invention is characterized in that a pitch for spinning prepared by melt mixing (A) an optically isotropic pitch having a softening point of 230°~300° C. obtained by heat treatment of a pitch while blowing an oxygen containing gas into the pitch and (B) 10~50 parts by weight, based on 100 parts by weight of the pitch (A) , of an optically isotropic pitch having a softening point of 200°~270° C. and having a property of being converted into an optically anisotropic pitch by a stress at the time of spinning thereof is spun into fibers and the fibers thus obtained are infusibilized, followed by carbonization and/or graphitization.

In the present invention it is preferred that the above-mentioned optically isotropic pitch (B) be a pitch obtained by polymerizing naphthalene in the presence of a Lewis acid catalyst.

In accordance with the present invention, there are obtained activated carbon fibers or carbon fibers, the surface layer portion thereof shows optical isotropy and the interior portion thereof shows optical anisotropy.

DETAILED DESCRIPTION OF THE INVENTION

The process for producing activated carbon fibers, process for producing carbon fibers according to the present invention, and the activated carbon fibers and carbon fibers thus obtained are illustrated below in detail.

In the spinning pitch used in the invention, the optically isotropic pitch used as the component (A) is a pitch having a softening point of 230°~300° C. obtained by heat treatment of a pitch while blowing an oxygen containing gas into the starting pitch.

The starting pitch to be used is not particularly limited in kind and any classes of pitch may be used so long as they come to be optically isotropic and have the above-mentioned softening point by the heat treatment thereof while blowing an oxygen containing gas into the starting pitch. Examples of the starting pitch used herein include those prepared, through such treatment processes as filtration, distillation, hydrogenation, or catalytic cracking, from a petroleum pitch (heavy oil), for example, residual oil of crude oil distillation, a fluid catalytic cracking (FCC) heavy oil, a naphtha cracking residual oil, or an ethylene bottom oil, and from a coal pitch (heavy oil), for example, coal tar or liquefied coal oil. Of those exemplified above, preferred are those prepared from the fluid catalytic cracking heavy oil from the standpoint of particular reactivity with oxygen, high softening point, etc.

No particular limitation is placed on the process for the treatment of the above-mentioned starting pitch, and there may be employed any of those which give the substantially optically isotropic pitch having the softening points as defined above by heat treatment of said starting pitch while blowing an oxygen containing gas into the starting pitch. However, the treatment method as will be mentioned below is employed preferably.

That is, the heat treatment of the starting pitch is carried out first at normal pressure to a slight pressure of about 0.3 kg/cm$^2$.G and a temperature of from 300 to 370° C. while blowing an oxygen containing gas into the pitch, and the heat treatment is stopped just before the formation of an optically anisotropic component occurred. In that case, the heat treatment time is usually about 5–12 hours. By this heat treatment, there is obtained an optically isotropic pitch having a softening point of 230°–300° C., preferably about 240°–270° C., in which the content of quinoline-insolubles (hereinafter called QI) is as low as about 0–15% by weight, no optically anisotropic component is contained, and polymerization and/or crosslinking have proceeded to a certain extent.

If necessary, the softening point of the optically isotropic pitch obtained above may be raised to 250°–300° C. by subjecting the above-obtained optically isotropic pitch to heat treatment under a reduced pressure of usually not more than 100 Torr, preferably 5–30 Torr and at a temperature of about 300°–370° C. for 10 minutes to 3 hours, preferably 20 minutes to 1 hour while blowing an oxygen containing gas into the pitch.

The oxygen containing gas used in the heat treatment mentioned above includes, for example, air or oxygen-enriched gases. From the standpoint of availability, however, air is preferred. The amount of oxygen used in that case is usually 0.2–5 NL/min, preferably 0.5–2 NL/min, based on 1 kg of the pitch to be heat treated, and the air is used in an amount of about 4 times that of the oxygen. If inert gases such as nitrogen gas is used instead of the oxygen containing gas, the pitch subjected to heat treatment is hard to maintain an optically isotropic structure, thereby increasing optically anisotropic components and attaining no objects of the invention.

This heat treatment may be carried out either batchwise or continuously. When the heat treatment is carried out in a continuous manner, any devices may be employed so long as they include extruders equipped with deaerating holes, for example, a pelletizer for forming plastic pellets, and a mixer-kneader for plastics, a self-cleaning type extruder for deaeration and removal of by-products associated with polycondensation of monomers.

The optically isotropic pitch obtained as the component (A) in the manner as mentioned above has such a low QI content as about 0–15% by weight, generally not more than 5% by weight, and such a high softening point (measured by Mettler method) of 230°–300° C. If the softening point is less than 230° C., the component (A) is hard to be infusibilized, and if the softening point exceeds 300° C., the viscosity of the component (A) becomes too high to spin and, moreover, optically anisotropic components are liable to be included into the component (A).

The spinning pitch used in the invention contains as the component (B) an optically isotropic pitch having a softening point of 200°–270° C. and a property of being converted into an optical anisotropic pitch by the stress at the time of spinning. The optically isotropic pitch (B) is obtained, for example, by polymerizing naphthalene in the presence of Lewis acid catalyst.

In practicing the polymerization of naphthalene, the naphthalene is subjected in the presence of Lewis acid catalyst to a heat treatment at a temperature of about 230°–300° C. The treatment time, though it is influenced by the temperature employed and the kind and amount of the catalyst used, cannot be decided indiscriminately, the treatment is continued until the polymerizate is found to be an optically isotropic pitch having a softening point of 200°–270° C. The treatment time is generally 10 minutes to about 5 hours.

The Lewis acid catalyst to be used includes, for example, hydrogen fluoride, boron trifluoride, anhydrous aluminum chloride, anhydrous ferric chloride, etc., and these catalysts may be used either singly or in combination of two or more.

The optically isotropic pitch (B) having the property of being converted into an optically anisotropic pitch by the stress at the time of spinning is obtained preferably by the process mentioned above. In addition thereto, however, an optically isotropic pitch obtained by collecting components readily convertible into an optically anisotropic pitch by solvent extraction from heavy oils or pitches, or an optically isotropic pitch readily convertible into an optically anisotropic pitch prepared by reducing an anioptically isotropic pitch may also be used. Such optically aisotropic pitch (B) as having the properties of readily convertible into an optically anisotropic pitch may be obtained by starting from petroleum or coal materials.

In order to facilitate the mixing of the component (B) with the component (A) and operate the spinning smoothly, the softening point of the component (B) approximates that of the component (A) and is slightly lower than that of the component (A) , for example, 200°–270° C., preferably 210°–260° C.

If the softening point of the component (B) is less than 200° C., the fibers obtained are poor in strength, and if the softening point exceeds 270° C., the viscosity of the component is excessively high and the spinning of the component (B) becomes difficult and, moreover, optically anisotropic components are liable to be included therein.

In the present invention, an optically isotropic pitch for spinning is obtained by mixing together 100 parts by weight of the aforementioned component (A) and 10–50 parts by weight, preferably 20–45 parts by weight of the component (B) in a molten state.

In the above case, when the amount of the component (B) is less than 10 parts by weight, the activated carbon fibers and carbon fibers obtained become low in strength, and if the amount exceeds 50 parts by weight, the specific surface area of the resulting activated carbon fibers becomes undesirably low.

The softening point of the spinning pitch obtained in the manner mentioned above by mixing together the component (A) and the component (B) is usually 210°–290° C., preferably 220°–280° C., and the QI content of the spinning pitch is usually 0–15% by weight, preferably 0–10% by weight.

The pitch for spinning obtained as above is spun according to conventionally known melt spinning technique into fibers. This pitch for spinning has good spinnability because it is an optically isotropic pitch, and the component (B) contained in the pitch is converted into an optically anisotropic pitch at the time of spinning and the fibers thus obtained have a double-layer structure. The surface layer portion thereof shows optical isotropy and the interior portion thereof shows optical anisotropy. This double-layer structure may be confirmed by observation of a cross section of the fibers by means of a polarization microscope.

Though the reason why the optically anisotropic portions are localized in the interior of the fiber is unknown, it is considered ascribable to the influence of stress distribution in the spinning nozzle.

Subsequently, an infusibilization treatment of the above-mentioned fibers is carried out. This infusibilization treatment is carried out by subjecting the fibers to a heat treatment at a temperature of 200°–400° C., preferably 260°–360° C. for about 5–300 minutes after raising the temperature at a rate of usually 1°–15° C./min, preferably 2°–12° C./min in an atmosphere of such a gas as oxygen, oxygen enriched gas, air or nitrogen oxide.

To prepare the activated carbon fibers, the fibers subjected to the infusibilization treatment are then subjected to activation treatment. As regards the way of activation treatment, no particular limit is placed thereon, and there can be employed any methods conventionally used in the preparation of activated carbon fibers. For example, the activation is performed by treating the fibers at a temperature preferably of 700°–1000° C. for a period of about 10 –150 minutes in an activation gas atmosphere such as water vapor, carbon dioxide or oxygen.

The fibers subjected to the infusibilization treatment may be carbonized at a low temperature prior to the activation treatment. The device for activation of the fibers to be used herein may be any of those known hitherto such as a batchwise and continuous devices.

Because the infusibilized fibers to be activated in the invention have a double layer structure, the surface layer portion thereof consists substantially of optically isotropic components liable to be activated, and the interior portion thereof contains optically anisotropic components hard to be activated, only the surface layer portion is activated while the interior portion is not activated too much, and hence the activated fibers thus obtained are excellent in strength.

In the activated carbon fibers thus obtained, the specific surface area is as large as about 1000–2000 $m^2/g$ comparable to that of activated carbon fibers obtained from a conventional optically isotropic pitch, and the fiber strength is as high as about 30–90 $kgf/mm^2$.

The activated carbon fibers obtained by the method of the invention are excellent in sliding property or electrical conductivity, and hence they are used as sliding material or electromagnetic wave shielding material, and because of their large specific surface area, they are used as catalyst carrier, adsorbent for solvent recovery device or air cleaning system, filter for use in water purification device, or in battery or condenser.

On the other hand, to produce the carbon fibers consisting of optically anisotropic components and optically isotropic components of the invention, the above-mentioned pitch for spinning is spun into fibers in the manner mentioned above, the resulting pitch fibers are infusibilized, and then the infusibilized fibers are carbonized and/or graphitized according to the conventionally known method, for example, by heating the fibers at 1,000°to 3,000 ° C. in an inert gas atmosphere such as nitrogen gas.

As mentioned above, since the surface portion of the infusibilized fibers consists essentially of the optically isotropic components and the interior portion of the infusibilized fibers contains the optically anisotropic components, the carbon fibers obtained by carbonizing and/or graphitizing the infusibilized fibers have high strength and high modulus of elasticity, are high in thermal conductivity and electrical conductivity and also excellent in sliding property, and hence they are used in wide applications.

The present invention is illustrated below in more detail with reference to examples, but it should be construed that the invention is in no way limited to those examples.

EXAMPLE 1

(1) Preparation of the component (A)

FCC heavy oil (softening point: 70° C.) obtained by flash distilling FCC decanted oil to cut a fraction of below 495° C. in terms of normal pressure was used as a starting pitch. This starting pitch was subjected to heat treatment at 350° C. for 9 hours while blowing air into the starting pitch at a rate of 1 NL/kg min to obtain an optically isotropic pitch having a softening point (Mettler softening point) of 250° C. and the QI content of 3% by weight at a yield of 70%. On observing under a polarization microscope, it was found that the pitch does not contain an optically anisotropic component.

(2) Preparation of the component (B)

Naphthalene was polymerized at 240° C. for 30 minutes by mixing it, based on 1 mole of the naphthalene, with 2 moles of hydrogen fluoride and 0.5 moles of boron trifluoride. After the completion of the polymerization, the Lewis acid catalyst was removed from the polymerizate to obtain an optically isotropic pitch having a softening point (Mettler softening point) of 230° C. On observing under a polarization microscope, it was found that the pitch does not contain an optically anisotropic component.

(3) Preparation of a pitch for spinning

A pitch for spinning was prepared by mixing 100 parts by weight of the optically isotropic pitch (component (A)) obtained in (1) above with 30 parts by weight of the optically isotropic pitch (component (B)) obtained in (2) above, followed by melt mixing with stirring at 280° C. for 30 minutes. On observing under a polarization microscope, it was found that this pitch for spinning thus obtained was an optically isotropic pitch.

The pitch for spinning obtained above had a softening point (Mettler softening point) of 245° C. and the QI content of 3% by weight.

(4) Preparation of activated carbon fiber

Pitch fibers having a diameter of 18 μm were obtained by melt spinning the pitch for spinning obtained in (3) above at a spinning temperature of 270° C. through a nozzle having an inside diameter of 0.3 mm at a take-up rate of 500 m/min. On observing under a polarization microscope, it was confirmed that the fibers have a double layer structure, the surface layer portion thereof shows optical isotropy, while 20% of the center portion of the cross-section of the fiber shows optical anisotropy.

The fibers thus obtained were infusibilized by heating from 120° C. up to 300° C. at an elevation rate of 3° C./min.

Subsequently, activated carbon fibers were prepared by subjecting the infusibilized fibers thus obtained to activation treatment for 20 minutes at 950° C. by means of water vapor.

The activated carbon fibers thus obtained were found to have a high specific surface area such as 1500 $m^2/g$ and a large fiber strength such as 60 $kgf/mm^2$. When the cross-section of this activated carbon fiber was observed under a polarization microscope, it was found that the surface layer portion of the fiber shows optical isotropy, while the interior portion of the fiber shows optical anisotropy.

Comparative Example 1

A pitch for spinning was prepared by mixing 80 parts by weight of the optically isotropic pitch (component (A)) having a softening point of 250° C. obtained in the same manner as in (1) of Example 1 and 20 parts by weight of a pulverized optically anisotropic pitch having a softening point of 265° C. with stirring at 280° C. Spinning this pitch into fibers at a temperature of 270° C., however, was inoperable because of many breakings of fibers brought about thereby.

Comparative Example 2

Activated carbon fibers having a specific surface area of 1520 $m^2/g$ and a fiber strength of 10 $kgf/mm^2$ were obtained by spinning the optically isotropic pitch (component (A)) obtained in (1) of Example 1 into fibers, and infusibilizing the fibers, followed by activation treatment in the same manner as in (4) of Example 1.

EXAMPLE 2

A pitch for spinning was prepared by adding 50 parts by weight of the component (B) obtained in Example 1 to 100 parts by weight of the component (A) obtained in Example 1, followed by melting, mixing and stirring at 280° C. for 30 minutes. On observing under a polarization microscope, it was found that the pitch thus obtained was an optically isotropic pitch.

The pitch obtained above was found to have a softening point (Mettler softening point) of 243° C. and the QI content of 3% by weight.

Fibers having a fiber diameter of 18 μm were obtained by melt spinning this pitch through a nozzle having an inside diameter of 0.3 mm at a spinning temperature of 265° C. and a take-up rate of 500 m/min. On observing a cross-section of the fiber under a polarization microscope, the surface layer portion of the fiber shows optical isotropy. While 33% of the center portion of the cross-section of the fiber shows optical anisotropy.

Activated carbon fibers were obtained by infusibilizing the above-mentioned fibers under the same conditions as in Example 1, followed by activation treatment. The activated carbon fibers thus obtained were found to have a specific surface area of 1300 $m^2/g$ and a fiber strength of 86 $kgf/mm^2$.

On observing the cross-section of this activated carbon fiber under a polarization microscope, it was found that the surface layer portion of the fiber shows optical isotropy, while the interior portion of the fiber shows optical anisotropy.

EXAMPLE 3

Fibers having a fiber diameter of 18 μm were obtained by melt spinning the pitch for spinning obtained in (3) of Example 1 through a nozzle having an inside diameter of 0.3 mm at a spinning temperature of 270° C. and a take-up rate of 500 m/min. On observing the cross-section of the fiber under a polarization microscope, it was confirmed that the fiber has a double-layer structure. The surface layer portion of the fiber shows optical isotropy, while 20% of the center portion of the cross-section of the fiber shows optical anisotropy.

The fibers thus obtained were infusibilized by heating from 120° C. to 300° C. at an elevation rate of 3° C./min. Thereafter, the infusibilized fibers thus obtained were carbonized in an inert gas atmosphere at a temperature of 1500° C. and of 2000° C. to obtain carbon fibers.

Physical properties of the carbon fibers thus obtained are shown in Table 1. On observing a cross-section of the fiber under a polarization microscope, the surface layer of the fiber shows optical isotropy and the interior portion of the cross-section of the fiber shows optical anisotropy.

TABLE 1

| Carbonization temperature °C. | 1500 | 2000 |
|---|---|---|
| Tensile strength kgf/mm$^2$ | 160 | 190 |
| Tensile modulus $10^3$ kgf/mm$^2$ | 14 | 18 |
| Specific resistance $10^{-3}\Omega \cdot$ cm | 3.0 | 2.1 |

According to the present invention, there are obtained activated carbon fibers having a large specific surface area comparative to that of the activated carbon fibers obtained from a conventional optically isotropic pitch and a high fiber strength by the process of the invention which comprises spinning a pitch for spinning obtained by melt mixing together an optically isotropic pitch obtained by heat treatment of pitch while blowing an oxygen containing gas thereinto and a specific amount of an optically isotropic pitch convertible into an optically anisotropic pitch by the stress at the time of spinning into fibers, and infusibilizing the resulting fibers, followed by activation treatment.

Further, according to the invention there are obtained carbon fibers having a high strength, a high modulus of elasticity and excellent sliding property by spinning the above-mentioned pitch for spinning into fibers, and infusibilizing the resulting fibers, followed by carbonization and/or graphitization.

What is claimed is:

1. A process for producing activated carbon fibers consisting of optically anisotropic components and optically isotropic components, which comprises spinning into fibers a pitch for spinning, infusibilizing the fibers thus obtained, and activating the infusibilized fibers, wherein the pitch for spinning is prepared by melt mixing (A) a first optically isotropic pitch having a softening point of 230°–300° C. obtained by heat treatment of a pitch while blowing an oxygen containing gas into the pitch and (B) 10–50 parts by weight, based on 100 parts by weight of the pitch (A), of a second optically isotropic pitch having a softening point of 200°–270° C., said second optically isotropic pitch having a property of being converted into an optically anisotropic pitch by a stress at the time of spinning thereof.

2. The process for producing activated carbon fibers as claimed in claim 1 wherein said second optically isotropic pitch (B) is a pitch obtained by polymerization of naphthalene in the presence of a Lewis acid catalyst.

3. A process for producing carbon fibers consisting of optically anisotropic components and optically isotropic components, which comprises spinning into fibers a pitch for spinning, infusibilizing the fibers thus obtained, and carbonizing and/or graphitizing the infusibilized fibers, wherein the pitch for spinning is prepared by melt mixing (A) a first optically isotropic pitch having a softening point of 230°–300° C. obtained by heat treatment of a pitch while blowing an oxygen containing gas into the pitch and (B) 10–50 parts by weight, based on 100 parts by weight of the pitch (A), of a second optically isotropic pitch having a softening point of 200°–270° C. and having a property of being converted into an optically anisotropic pitch by a stress at the time of spinning thereof.

4. The process for producing carbon fibers as claimed in claim 3 wherein said second optically isotropic pitch (B) is a pitch obtained by polymerization of naphthalene in the presence of a Lewis acid catalyst.

5. The process for producing activated carbon fibers as claimed in claim 1, wherein the surface portion of the activated carbon fibers obtained shows optical isotropy, while the interior portion of the activated carbon fibers shows optical anisotropy.

6. The process for producing carbon fibers as claimed in claim 3, wherein the surface portion of the carbon fibers obtained shows optical isotropy, while the interior portion of the carbon fiber shows optical anisotropy.

* * * * *